United States Patent [19]

Fiebiger

[11] 4,351,179

[45] Sep. 28, 1982

[54] MANUAL RIVETING TOOL

[75] Inventor: Josef Fiebiger, Dingolfing, Fed. Rep. of Germany

[73] Assignee: Gesipa Blindniettechnik Gesellschaft mit Beschränkter Haftung, Frankfurt am Main, Fed. Rep. of Germany

[21] Appl. No.: 62,615

[22] Filed: Aug. 1, 1979

[30] Foreign Application Priority Data

Aug. 4, 1978 [DE] Fed. Rep. of Germany ... 7823317[U]
Aug. 4, 1978 [DE] Fed. Rep. of Germany ..... 2834160

[51] Int. Cl.[3] ..... B21J 15/34
[52] U.S. Cl. ..... 72/391; 81/177 R
[58] Field of Search ..... 72/391, 409; 81/177 R, 81/177 A, 177 G, 177.8

[56] References Cited

U.S. PATENT DOCUMENTS

| | | | |
|---|---|---|---|
| 1,126,678 | 2/1915 | Apfeld | 81/177 A |
| 2,519,693 | 8/1950 | Olin | 72/391 |
| 2,641,378 | 6/1953 | Wilt | 72/391 |
| 3,124,983 | 3/1964 | Emerzian | 81/177 R |
| 3,383,962 | 5/1968 | Harris | 81/177 R |
| 3,491,578 | 1/1970 | Biermann | 72/391 |
| 4,004,476 | 1/1977 | DeVrou | 81/177 A |

FOREIGN PATENT DOCUMENTS

| | | | |
|---|---|---|---|
| 362343 | 8/1938 | Italy | 72/391 |

*Primary Examiner*—Gene Crosby
*Attorney, Agent, or Firm*—Montague & Ross

[57] ABSTRACT

A manual riveting tool for the setting of blind rivets comprises a flat head whose housing carries the chuck which engages the mandrel and at least one pivotable member which is coupled with the chuck by a transmission in the head to draw the mandrel through the rivet and tear away. According to the invention, this member is provided with a lever to which an actuating arm can be removably connected by a plug-and-socket arrangement and the member further, at one of its ends at a side of the housing can be engaged by a standard socket wrench via another plug-and-socket connection. The housing may be formed with part of still a further plug-and-socket connection, e.g. for engagement by a handle. The plug-and-socket connections can be standard socket-wrench elements.

5 Claims, 11 Drawing Figures

MANUAL RIVETING TOOL

FIELD OF THE INVENTION

This invention relates to a manual riveting tool for the setting of blind rivets and particularly blind rivets which require the application of high forces for the setting thereof, consisting of a housing with two arms at least one of which is mounted rotatably on the tongs housing, power transmission means and a chuck mechanism for gripping the mandrel of the blind rivet.

BACKGROUND OF THE INVENTION

Tools for the riveting for blind rivets in which the force necessary for deforming the blind rivet which consists of a hollow rivet and a pull mandrel which can be torn off is applied manually are known. They comprise generally a housing which terminates, for instance, in a fixed arm of a pair of tongs and of another tongs arm. The movable arm, which is rotatably supported in the housing bears or acts on the chuck mechanism. By operating the arms of the tongs, and particularly by closing the movable arm, the riveting is effected. The transmission of power upon an actuation is effected in this case generally by a lever arm between the mounting point of the movable arm and tong-arm handle on the one hand and the mounting point of the articulated chuck mechanism on the other hand. Due to the simple lever-arm arrangement these tools cannot be used for all sizes of rivets when working with blind rivets. To be sure, manual riveting tongs are known the arms of which are made particularly long in order to increase the force transmission ratio but they are subject to practical limits so that only blind rivets up to a certain maximum diameter can be riveted by hand with such tools.

For the riveting of blind rivets of larger diameter there are known manual riveting tools which are provided between the actuating lever or movable tongs arm and the chuck mechanism with a special device for the transmission of force. Such tools are known both in the embodiment with one tongs arm fixed on the housing and one movable tongs arm and in the embodiment with two movable tongs arms.

West German Provisional Pat. No. 1,216,656 describes such a manual riveting tool developed as so-called lever riveter, it consisting of a housing with one tongs arm rigidly connected to it and a tongs arm which is rotatably mounted in the housing. The chuck mechanism for gripping the rivet mandrel is borne by a rack which is displaceably arranged in the housing. Between the rotatable tong arm and said rack there is rotatably supported a segment-shaped gear wheel element for the transmission of force. The toothing on one end of the gear wheel element is in engagement with the rack while a pinion developed on the movable tong arm engages into the toothing at the other end of the gear wheel element. With this tool it is possible to rivet blind rivets with high tensile forces such as for instance 6 mm diameter blind rivets of Alu alloy or 5 mm diameter blind rivets of alloy steel with only slight manual expenditure of force. This manual riveting tool therefore has relatively long tong arms with a large opening angle. Due to the pre-established length of the tong arms, their arrangement and the space for movement necessary for actuation the known tool cannot easily be used in confined spaces for instance in a shaft, a drawer, on structural shapes, etc. since the riveting place either cannot be reached at all or the required space for movement is not available. Known riveting tools operated by external power without tong arms cannot always be used in such cases due to a lack of source of energy, such as for instance compressed air or electricity.

OBJECT OF THE INVENTION

The object of the present invention is to create a manual riveting tool which while retaining the transmission ratios obtained in the prior art can be used universally and in particular, even in confined spaces and can be actuated preferably by hand in different planes.

SUMMARY OF THE INVENTION

In accordance with the invention this is achieved in that the arms of the tongs are detachable and/or repluggable or rescrewable and that at least one further point of connection is provided on the tongs housing.

This further point of connection can be provided on the bottom of the housing.

The point of connection or one of the further points of connection can preferably be provided at the fulcrum of the movable arm.

A further point of connection is preferably provided at the bottom of the housing and at least one second further point of connection is provided at the fulcrum of the movable tong arm.

In the case of two movable tong arms a point of connection can be provided at each fulcrum.

The further point of connection at the tong housing is preferably adapted to be connected to an ordinary commercial handle.

The points of connection provided at the fulcrum of one or both movable tong arms are preferably adapted to be connected to a force-transmission tool such as, for instance, an ordinary ratchet wrench or a torque wrench.

The bearing pin or pins at the fulcrum of the movable tong arm or arms can be developed as points of connection.

The points of connection (at the fulcrum of an arm or both arms) are preferably developed for lateral and/or bilateral drive.

All points of connection on the housing and on the fulcrums of the movable tong arm or arms can advanageously be provided as standard plug connections for commercial tools (for instance German Industrial Standard DIN 3120 with ball-stop for use of standard fastening parts in accordance with DIN 3122 and 3123), or screw or quick-change fasteners (for instance a bayonet catch).

The manual riveting tool in accordance with the invention has on the one hand the properties and advantages of the known manual riveting tools for the working of blind rivets with high tensile force and retains same and is on the other hand highly versatile and easily varied by means of repluggable tong arms and additional commercial standard tools (drive and connecting parts) and in particular suited to be adapted to the spatial conditions in which the work is to be carried out. In this way the range of use of so-called large manual riveting tools is considerably broadened in a rational manner. The manual riveting tool of the invention can be used in particular at places where no external power connection is present but where, due to confined spatial conditions, long tong arms can also not be actuated.

By the possibility of the use of a commercial tool such as, for instance, a ratchet wrench on the lateral drive connection the structural length of the tool can be substantially reduced. Thus when using a ratchet wrench the large angle of actuation of one or both tong arms which is otherwise necessary is done away with and the riveting process is carried out by small angular strokes within a a very small space.

However, also by simply shifting the detachable tong arms the riveting tool of the invention can already have the operating space which it otherwise requires, substantially reduced.

The tool can be fully employed in different spatial planes from the vertical to the horizontal.

The transition between different standard plug connections (square, hexagon, 12-point etc.) can be readily produced by connecting parts which are also standardized (intermediate members).

By standard extension pieces the range of use can be made even greater. For instance, the actuating plane is shifted in parallel to itself by a corresponding amount or a tong arm or an ordinary commercial handle is lengthened so as to be able to reach also lower or higher riveting places.

BRIEF DESCRIPTION OF THE DRAWING

Further features and advantages of the invention will be described in further below with reference to the accompanying drawing.

SPECIFIC DESCRIPTION

The invention is explained in the figures on the example of an ordinary commercial large manual riveting tool, a so-called lever riveter.

Figure 1B:
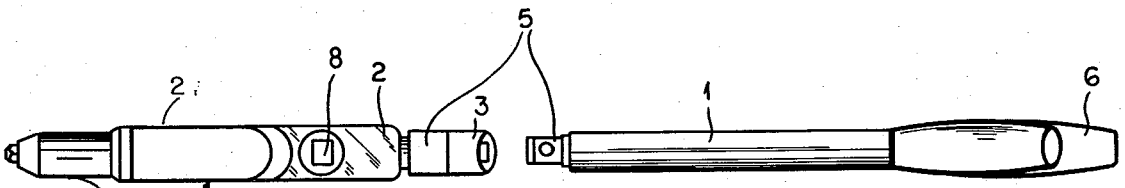
FIG. 1*b* is a view of the manual riveting tool seen in the direction of the arrow A in FIG. 1*a;*
Figure 1A:
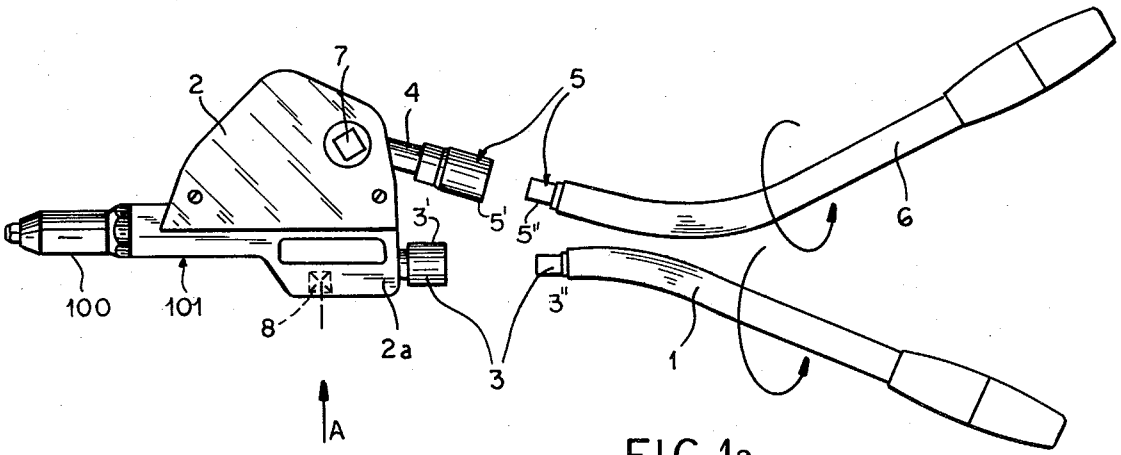
FIG. 1*a* is a side view of a manual riveting tool with removable tong arms in accordance with the invention.

In accordance with FIG. 1*a,* the stationary tong arm 1 can be mounted rigidly in the direction of the longitudinal axis of the tool on the lower part 2*a* of the tong housing 2, which forms the usual head 101 of the tool whose mandrel-engaging chuck can be actuated, by means of a "square" plug connection 5' or detachable from it. A rotatable drive part 4 coupled to the chuck 100 which is operatively connected with the power transmission arrangement contained within the housing 2 (which drive part is rotatable around an axis extending perpendicular to the plane of the drawing) bears the one part of another (square) plug connection 5 the counterpart of which is present on the movable tong arm 6 so that the latter can be detachably connected the tong housing 2 and the drive part 4 in the same plane as the immovable tong arm 1. Thus members 3 and 4 form actuating members.

Male and female parts (first elements 3", 5" and second elements 3', 5', respectively) of the plug connections 3, 5 can be provided at any desired place on the tong housing 2 or the tong arms 1,6. By special selection or arrangement of the parts of the plug connections 3, 5 the movable and immovable tong arms 6,1 can, for instance, be made non-interchangeable. In the embodiment shown, the tong arms 1 and 6 can be attached 90° apart (see arrows).

In accordance with the invention the drive part a is provided at its fulcrum with a continuous square hole as connecting point 7, which hole is accessible through openings on both sides in the housing 2 and as will be described further below permits the lateral connection of another commercial drive tool by plug connection from the right or left. Preferably for this purpose the mounting pin of the drive part 4 is connected with the latter to form a turnable drive unit and extended out of the housing 2 on both sides; the connecting point 7 which is developed as a square hole is then provided in the mounting bolt, for instance in the axis of rotation of the drive part 4.

The mounting bolt can in this case also itself be developed as a ratchet wrench.

Figure 2:
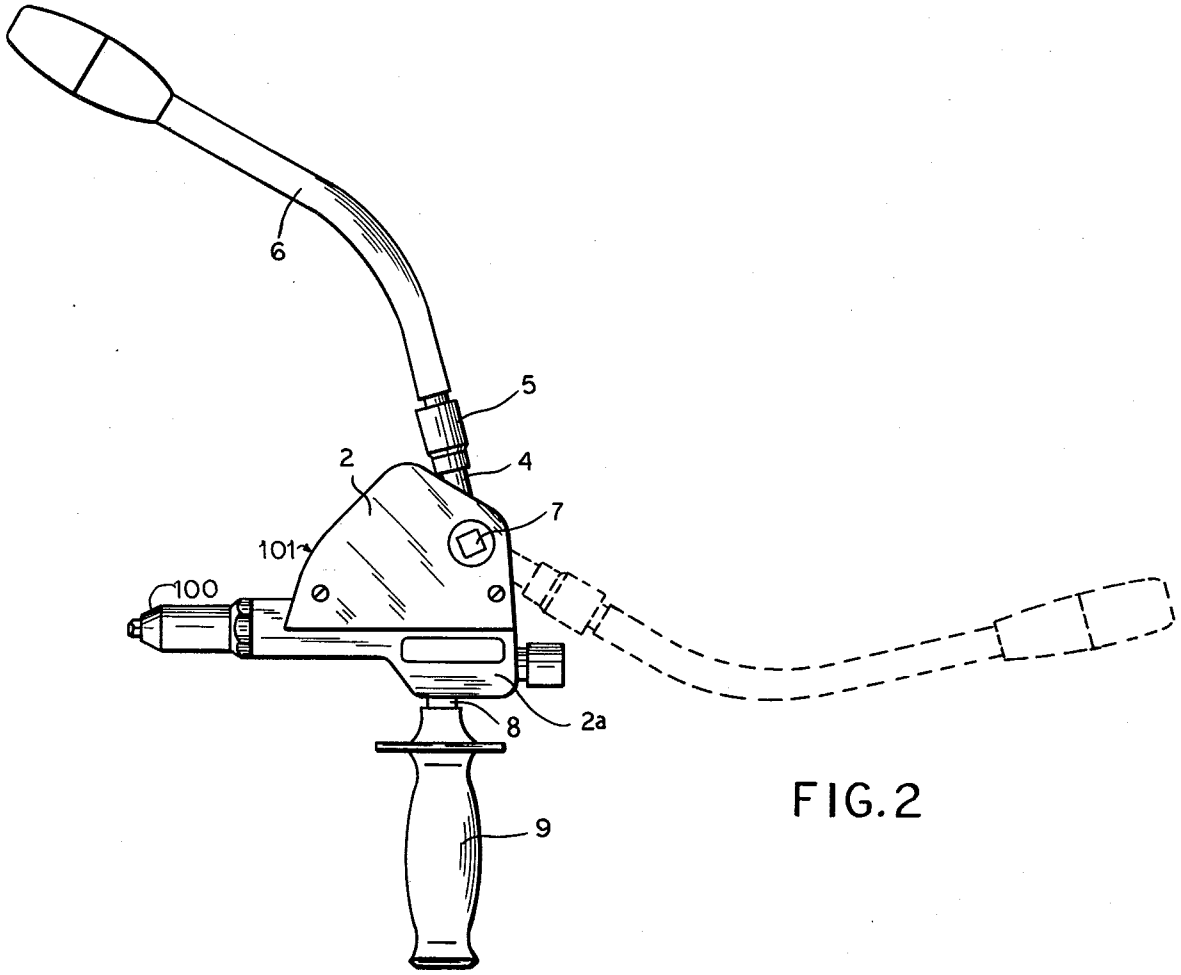
FIG. 2 shows the manual riveting tool of FIG. 1*a* with a handle rigidly mounted on the connection visible in FIG. 1*b* and located on the bottom of the housing, and the movable tong arm mounted in normal manner.
Figure 3:
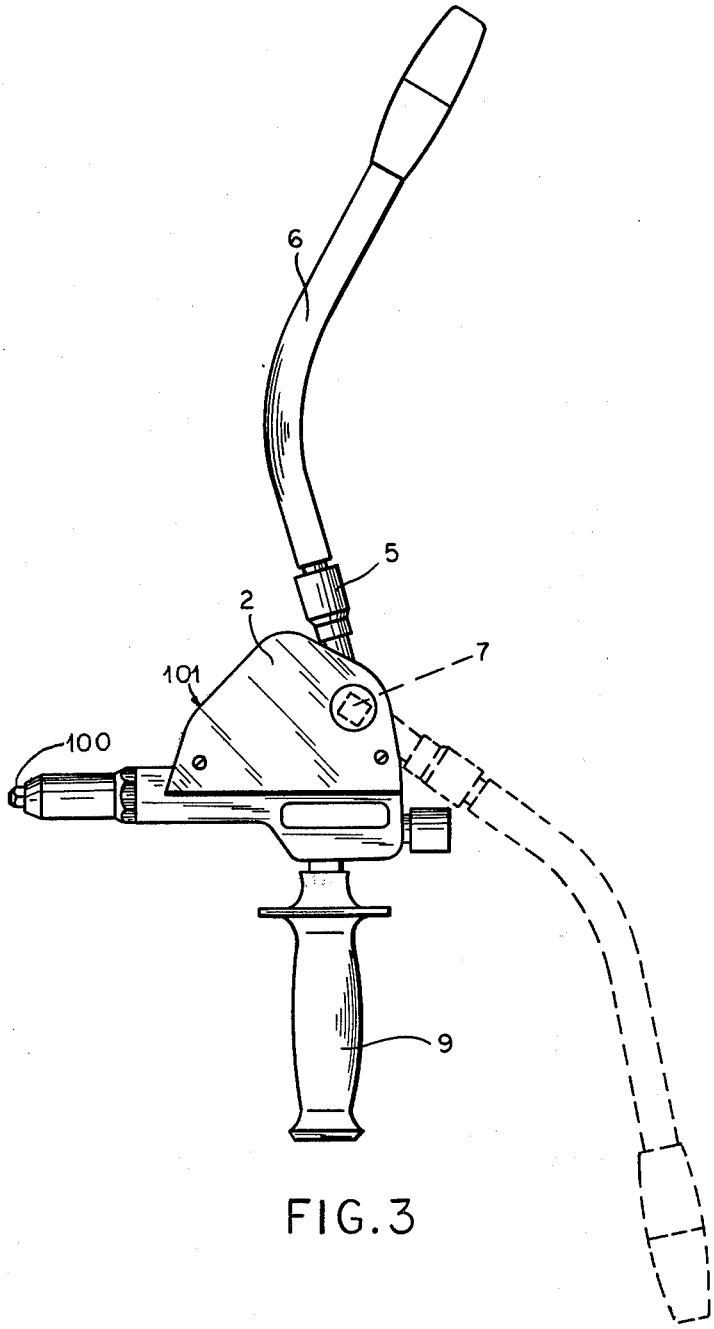
FIG. 3 shows the manual riveting tool of FIG. 1 with the handle rigidly mounted again on the bottom, the movable tong arm being turned 180° at its normal point of connection.

FIG. 1*b* is the view of the manual riveting tool as seen in the direction of the arrow A in FIG. 1*a.* It can be noted here that on the bottom of the tong housing 2 there is provided a further square blind hole as connecting point 8, which forms a plug connection for a rigid handle 9, in accordance with FIGS. 2 to 4. In this case also male and female parts of the plug connection can be provided as desired on the tong housing 2 or handle 9. Instead of the square connection there is possible in all cases of the plug connections 3, 5, 7, 8 also hexagon or 12-point connections or, by means of threaded or quick-change parts as well as standardized adapter parts connection between a square connection and a hexagon or 12-point standard tool, etc., or between different inch sizes of connecting squares can be produced (for instance in accordance with DIN 3120 with ball lock for parts DIN 3122 and 3123).

If the tong arms 1, 6 are connected by the plug connections 3,5 according to FIG. 1*a* with the tong housing 2 one obtains initially a manual riveting tool which is in accord with West German Provisional Pat. No. 1,216,656.

By the development in accordance with the invention of the manual riveting tool with the different plug connections the tool can be modified in various manners including those set forth below and adapted in particular to the spatial conditions in which the work is to be carried out.

In accordance with FIG. 2 the stationary tong arm 1 is detached from its plug connection 3 on the tong housing 2. Instead of it the handle 9 is rigidly applied via the connecting point 8 on the bottom of the housing 2 which is also developed for a plug connection. The movable tong arm 6 is connected in normal manner via the plug connection 5 to the drive part 4.

The actuating of the tool takes place in the plane of the drawing with a large angle of actuation. There is the possibility of mounting the stationary tong arm 1 in the connecting place 8 or of inserting the handle 9 there, as shown in FIG. 2. Although no space is gained by this a convenient adaptation to existing spaces is made possible. In this case the riveting tool can, as required, be held in horizontal or vertical direction or else obliquely.

Furthermore, also in accordance with FIG. 3 the fixed tong arm 1 is removed from the housing and instead of it the handle 9 is mounted on the bottom and the bent, movable tong arm 6 is connected, turned 180°, via the plug connection 5 to the drive part 4. In this case also actuation takes place in the plane of the drawing and with unchanged large opening angle of the movable tong arm 6. The range of movement of the free end of the movable tong arm 6 is however shifted towards the rear by such an amount that the tool can now be used in particular at places (also in different planes) where the space is limited at the actual place of riveting.

Figure 4A:
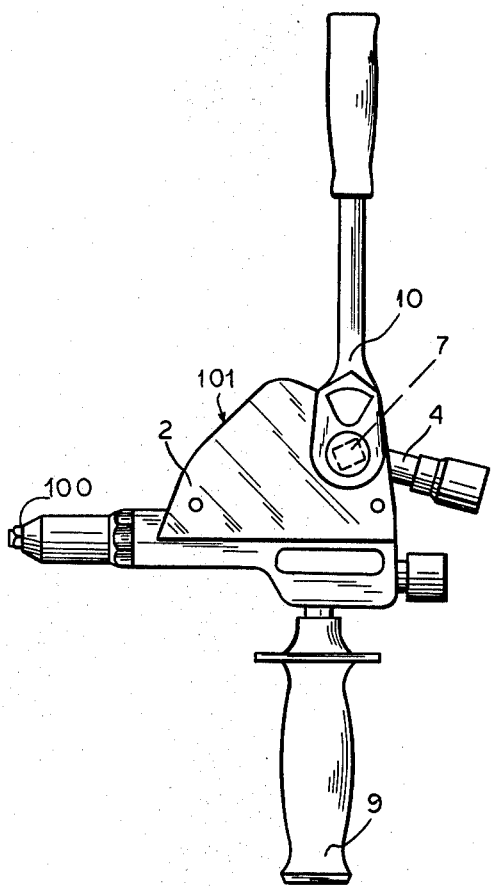
FIG. 4*a* shows the manual riveting tool of FIG. 1 with the handle rigidly mounted to its bottom and a drive tool (socket wrench) swingably mounted on a lateral operating connection.
Figure 4C:
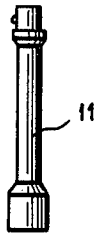
FIG. 4*c* shows a standard commercial extension piece.
Figure 4B:
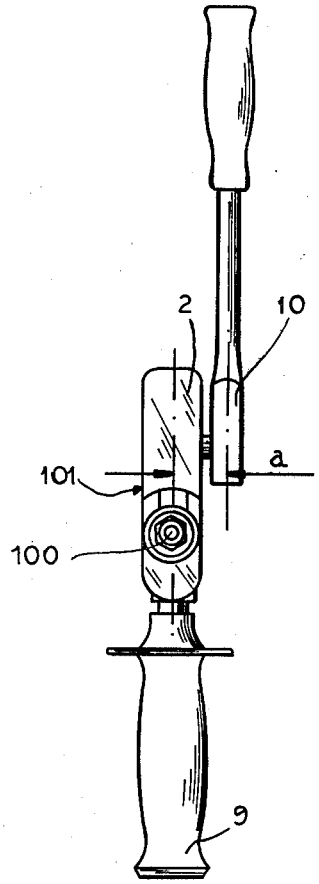
FIG. 4*b* is a front view of the manual riveting tool of FIG. 4*a.*

In accordance with FIGS. 4*a* and 4*b* the fixed tong arm is again removed from the housing and the handle 9 fastened in its place to the bottom of the housing 2. As actuating member, a tool which is bent at an angle with respect to the plug connection, in the case shown a ratchet wrench 10, is arranged on the lateral plug connection 7 provided in the mounting bolt of the drive part 4. In this way, as can be noted particularly clearly from FIG. 4*b*, the plane of actuation is shifted parallel to the manual riveting tool by a given amount a. By means of an extension piece as shown in FIG. 4*c* which is mounted between the plug connection place 7 on the housing 2 and the ratchet wrench 10 or some other ordinary tool which can be connected to the sides such as, for instance, an actuating lever with a universal joint, this displacement of the plane of actuation can be increased. Thus a projection or the like which would otherwise interfere with the actuation can be circumvented.

By connecting a ratchet wrench 10, the manual riveting tool can also be used at places where due to the local spatial conditions the swinging movement of the drive part 4 through the large opening angle as necessary for riveting cannot be carried out with one motion and therefore for instance in a narrow shaft. By the known locking action of a ratchet wrench 10, the large angle of opening of the drive part 4 can be gradually covered by a plurality of small angular strokes of the ratchet wrench 10 and the riveting process thus be completed. The work path is reduced and the actuating radius is made considerably smaller.

The manual riveting tool of the invention can be adapted in various ways to the existing working conditions.

In order to be able to reach higher or lower riveting places—in the latter case with upside-down working position of the tool and with preferably lateral actuating drive—the extension piece 11 can be inserted between the housing connection point 8 and the handle 9.

If the movable tong arm 6 which is part of the standard equipment is connected with the lateral plug connection point 7 the space above the tool is free, in which case, to be sure, the fact must be tolerated that the necessary manual actuating force is increased since in this case rotation takes place with only a small radius around the axis of the lateral plug connection point 7.

By the connection of a second handle with a plug connection part preferably arranged at right angles via a possibly articulated connecting piece on the lateral plug connection point 7 on the housing 2 there is obtained a sort of crank with which it is possible if necessary to rivet in a very narrow space, although with a somewhat greater expenditure of force.

Figure 5A:
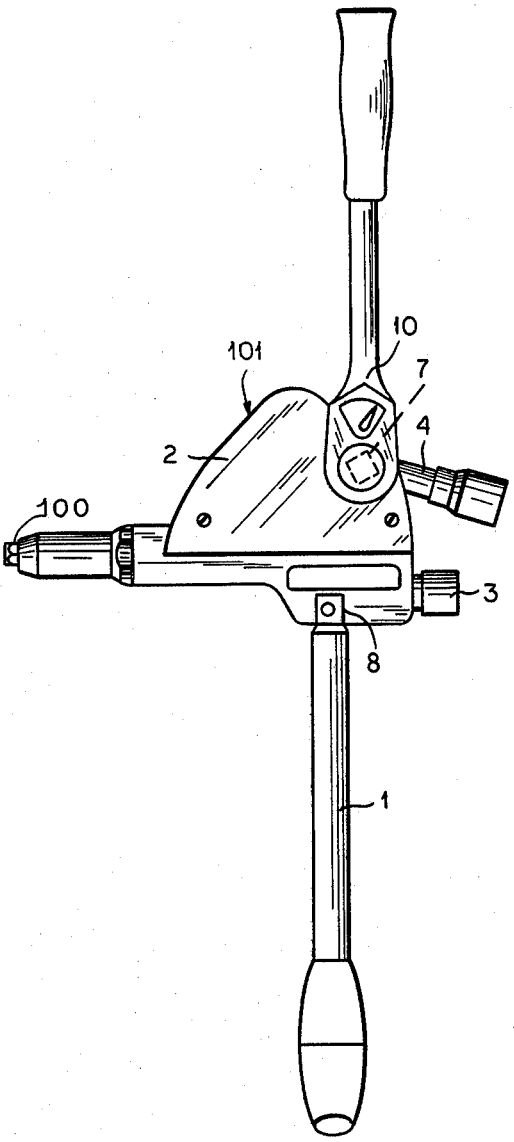
FIG. 5*a* shows the manual riveting tool of FIG. 1 with immovable tong arm swung on the bottom 90° from the working plane and with a drive tool, in this case an ordinary ratchet wrench, arranged swingably on a lateral actuating connection.
Figure 5B:
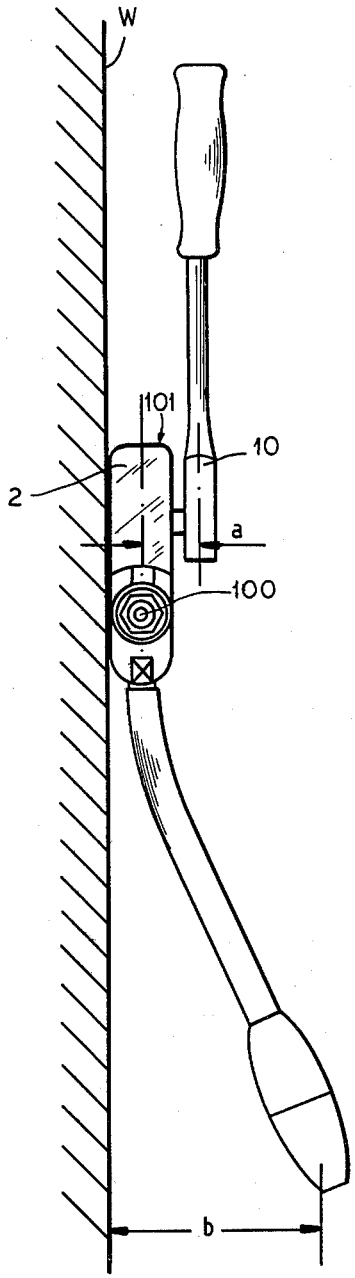
FIG. 5*b* shows a front view of the manual riveting tool of FIG. 5*a* in which the housing of the manual riveting tool is brought close, in operating position, to a wall.

In accordance with FIG. 5*a* the movable tong arm is removed from the housing 2 while the fixed tong arm 1 is loosened from its plug connection 3 on the housing 2 and rigidly mounted shifted 90° out of the working plane via the connecting point 8 developed for a plug connection on the bottom of the housing 2. As actuating member there is used on the lateral plug connection point 7 provided in the mounting bolt of the drive part 4 a tool which is bent at an angle with respect to the plug connection, namely in the embodiment shown a ratchet wrench 10. In this way, as shown in FIG. 5*b*, the plane of actuation is shifted parallel to the manual riveting tool by a given amount a and the handle of the tong arm 1 is shifted by the amount b. This makes it possible to rivet close to a wall, as shown by the application of the housing 2 against the wall W in FIG. 5*b*.

Figure 6:
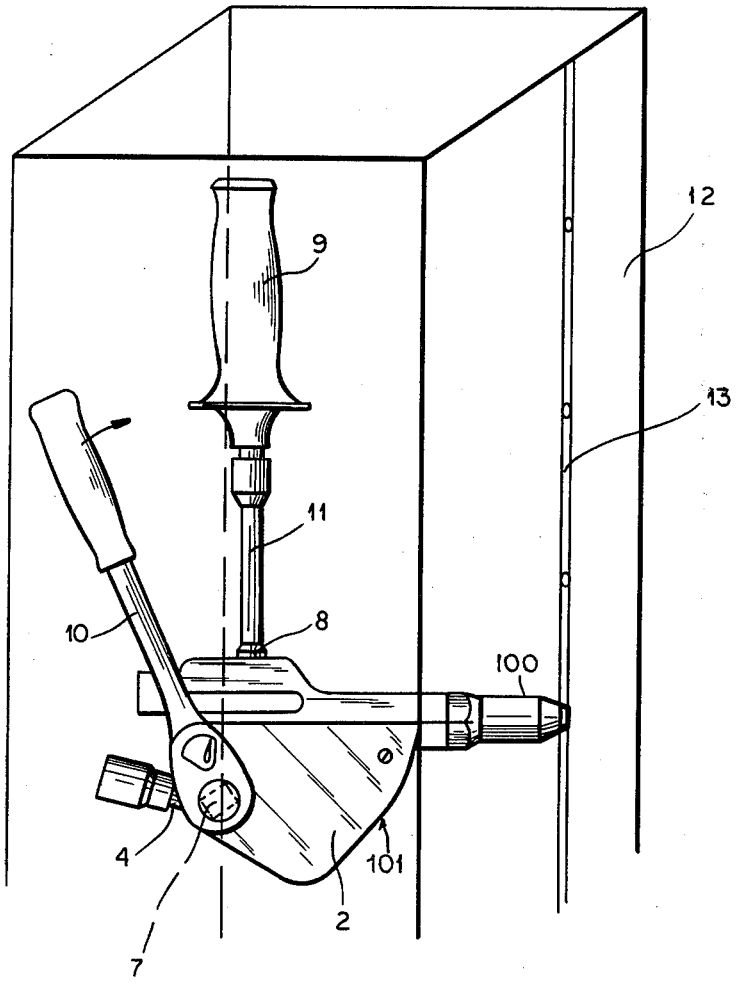
FIG. 6 shows an illustrative use of the manual riveting tool of the invention within a shaft.
Figure 7:
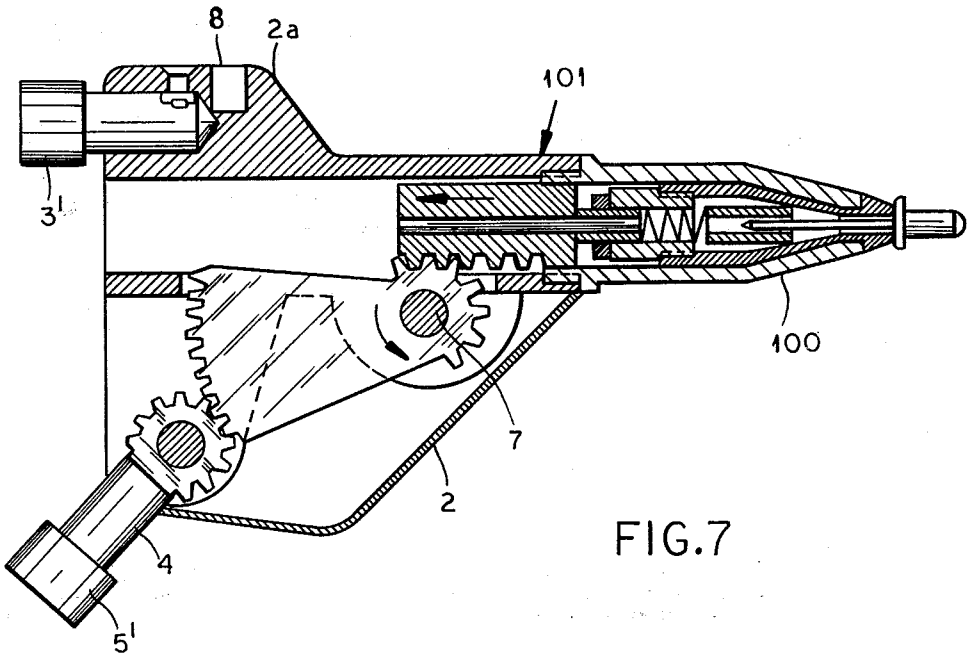
FIG. 7 is an illustration of the head in cross section showing the mandrel-engaging chuck with the rotatable member of the invention coupled thereto.

FIG. 6 shows diagrammatically an illustrative use of the riveting tool of the invention within a shaft. There is diagrammatically shown a shaft 12 of rectangular cross section along the one side wall of which there is a connecting seam 13 which is to be riveted. In order to reach the lower riveting points, as has been indicated above, the handle 9 is connected via the extension piece 11 with the connection place 8 located on the bottom of the housing 2 and the riveting tool is employed in upside-down position. On the lateral plug connection point 7 there is placed the ratchet wrench 10 by which, as already described, the large actuating or opening angle of the drive part 4 is overcome by a plurality of small angular strokes determined by the limited space and the correspondingly designed ratchet 10.

As results from the description, the manual riveting tool of the invention can be varied in various fashions by means of ordinary commercial standardized drive and connecting parts and thus adapted to the existing circumstances.

Aside from the example described other variations are also possible without going beyond the actual inventive concept.

In principle it is also possible to connect an external drive such as a compressed-air drive or an electric drive to the lateral plug connection point 7 of the housing 2. However, the invention primarily contemplates the use of the riveting tool at places where such external drive is not available.

Instead of the so-called lever riveter shown in the drawing, the invention can also be employed with other manual riveting tongs and riveting tools, the one tong arm being arranged rigidly and the other tong arm being arranged movably on the tong housing.

I claim:

1. A manually operable riveter for the setting of blind rivets of the type in which a mandrel is drawn through the rivet, comprising:

a riveting head formed with a flat housing, a mandrel-engaging chuck extending from one end of said housing, a rotatable member operatively coupled to said chuck for displacing same, and a pair of actuating members at an opposite end of said housing and adapted to form a pair of tongs, one of said actuating members being connected to said rotatable member for driving same;

respective arms each removably connectable to a respective one of said actuating members to form said tongs therewith, each arm having a first element and each actuating member a second element of a respective two-element detachable joint;

and means on said housing spaced from the other of said actuating members forming a second element of a detachable joint adapted to receive the first element of one of said arms.

2. A manually operable riveter for the setting of blind rivets of the type in which a mandrel is drawn through the rivet, comprising:

a riveting head formed with a flat housing, a mandrel-engaging chuck extending from one end of said housing, a rotatable member operatively coupled to said chuck for displacing same, and a pair of actuating members at an opposite end of said housing and adapted to form a pair of tongs, one of said actuating members being connected to said rotatable member for driving same;

respective arms each removably connectable to a respective one of said actuating members to form said tongs therewith, each arm having a first element and each actuacting member a second element of a respective two-element detachable joint; and means on said rotatable member and accessible laterally of said housing forming a joint element engageable by a socket wrench for driving said chuck thereby.

3. The riveter defined in claim 2, further comprising means on said housing spaced from the other of said actuating members forming a second element of a detachable joint adapted to receive the first element of one of said arms.

4. The riveter defined in claim 1 or claim 3 wherein said means on said housing is disposed on the bottom of said housing.

5. The riveter defined in claim 1, claim 2 or claim 3 wherein each of said joints is formed with at least one element constituting a member of a standard commerical plug-and-socket drive.

* * * * *